US006116054A

United States Patent [19]

Czupor

[11] Patent Number: 6,116,054

[45] Date of Patent: Sep. 12, 2000

[54] OPENABLE GEM SETTING

[76] Inventor: Stephen Francis Czupor, 22-18 21st St., Astoria, N.Y. 11105

[21] Appl. No.: 08/891,140

[22] Filed: Jul. 10, 1997

[51] Int. Cl.[7] ..... A44C 17/02

[52] U.S. Cl. ..... 63/26; 63/29.1

[58] Field of Search ..... 63/26, 29.1

[56] References Cited

U.S. PATENT DOCUMENTS

| | | | |
|---|---|---|---|
| 58,501 | 10/1866 | Stefani | 63/29.1 |
| 313,084 | 3/1885 | Kullmann | 63/29.1 |
| 394,928 | 12/1888 | Kutner | 63/29.1 |
| 672,366 | 4/1901 | Herzog | 63/29.1 |
| 686,572 | 11/1901 | Becher | 63/29.1 X |
| 1,726,926 | 9/1929 | Schwartz | 63/29.1 |
| 1,754,964 | 4/1930 | Pancoast | 63/26 X |
| 1,951,706 | 3/1934 | Powers | 63/26 |
| 4,819,453 | 4/1989 | McNamara | 63/26 X |
| 5,375,434 | 12/1994 | Wertheimer et al. | 63/29.1 |
| 5,432,988 | 7/1995 | Woo | 63/26 X |

FOREIGN PATENT DOCUMENTS

| | | | |
|---|---|---|---|
| 387582 | 5/1908 | France | 63/29.1 |
| 2260966 | 9/1975 | France | 63/28 |
| 16446 | 3/1898 | Switzerland | 63/29.1 |

*Primary Examiner*—Terry Lee Melius
*Assistant Examiner*—Andrea Chop

[57] ABSTRACT

An openable gem setting for a jewelry article in which a gemstone is removably retained by a removable holding plate, the plate being removably fastened to the jewelry article by means of a plurality of fasteners. The holding plate includes at least one major aperture adapted for the mounting of a gemstone, and at least two minor apertures through which portions of the fasteners extend and removably engage a part of the jewelry article.

6 Claims, 2 Drawing Sheets

OPENABLE GEM SETTING

FIELD OF THE INVENTION

This invention relates to jewelry articles, such as rings, pins, pendants, bracelets, necklaces and the like, which include settings adapted for the retention of gemstones and the like. More particularly, the present invention is directed to a setting whereby such gemstones may be readily replaced within the jewelry articles.

BACKGROUND OF THE INVENTION

This setting is for gems which permit for the interchangeability of the gems are known to the art. Such are described in the following U.S. Pat. Nos.: 257,023; 499,823; 529,814; 733,029; 816,997; 996,678; 1,864,371; 2,141,363; 2,316,225; 2,733,579; 2,811,024; 3,307,375; 3,933,011; 4,374,470; 4,800,738; 4,819,453; 4,905,482; 4,936,115; 5,052,195; 5,077,989; 5,133,195; 5,375,434.

While the art has proposed various settings, these vary widely in complexity, ease of use, security and the retention of the gem, coin or other article within the jewelry. Frequently, the appearance of some prior art settings is less than desirable, particularly in a jewelry article.

Among the objects of the present invention is the provision of a openable gem setting which permits for secure retention of gemstones, such as coins, gems, precious stones, semi-precious stones, as well as artificial and/or synthetic gems. The openable gem setting according to the invention permits for the ready removal of said gemstones, such as for cleaning, or especially by replacement with a different gemstone within the jewelry article.

SUMMARY OF THE INVENTION

According to the present invention there is provided an openable gem setting for a jewelry article in which a gemstone is removably retained by a removable holding plate, said plate being removably fastened to the body of a jewelry article by means of a plurality of fasteners. The holding plate includes at least one major aperture adapted for the mounting of a gemstone, and at least two minor apertures through which portions of the fasteners extend.

In this application, the term "gemstone" is to be understood to include without limitation: gems, precious stones, semi-precious stones, artificial or synthetic gemstones, as well as pearls, decorative minerals, amber, coins, simulated gemstones formed of polymeric materials or pastes, glass, beads, and like materials. Also "jewelry article" is to be understood to include, without limitation: bracelets, rings, pendants, earrings, belts, belt buckles, as well as clasps and fasteners of an ornamental nature. Such gemstones are partially inserted within a cavity within the body of the jewelry article or passage or a passage extending through the body of the jewelry article. Thereafter the holding plate is mounted upon the jewelry article such that the gemstone is at least partially visible through the major aperture. The minor apertures of the holding plate are lined up with respect to the body such that two or more fasteners, such as screws, threaded studs, friction fitted studs, or the like, are inserted therethrough and used to removably attach the holding plate to the body of the jewelry article. In such a manner, the openable gem setting taught herein provides for secure retention of the gemstone, yet it may be readily disassembled to permit for the substitution of a different gemstone within the same jewelry article.

DETAILED DISCLOSURE

Figure 1:
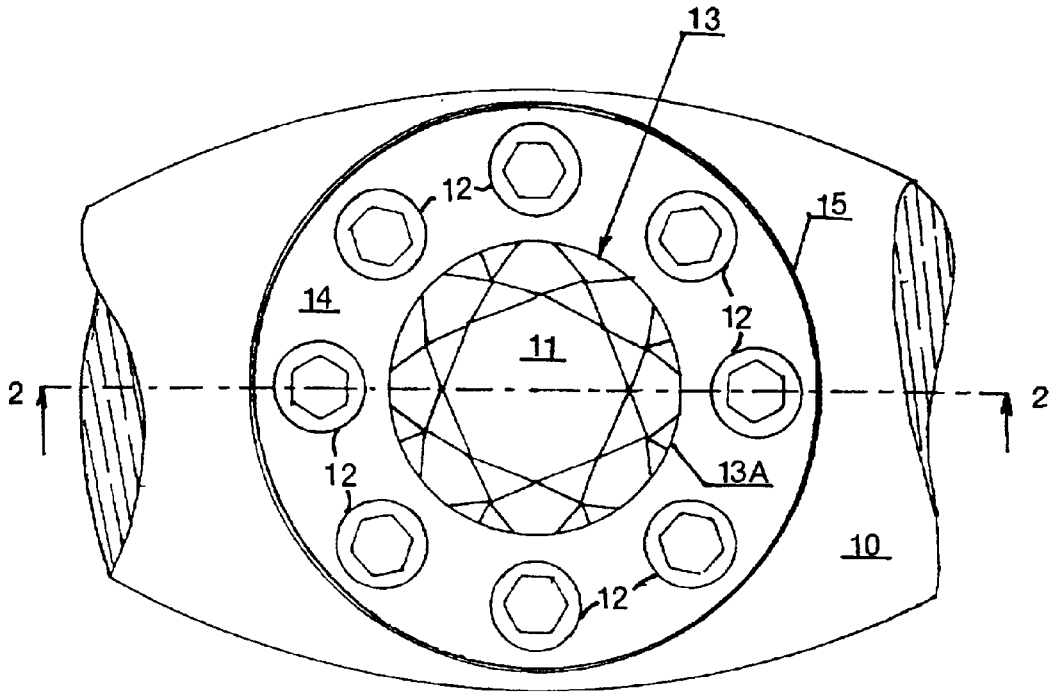
FIG. 1 is a top planar view of a portion of a jewelry article, a ring, illustrating a preferred embodiment of the openable gem setting of the invention.

Turning now to FIG. 1, therein is illustrated a top planar view of a portion of a ring illustrating a preferred embodiment of the openable gem setting according to the invention. As shown, the body (10) of the jewelry article (ring) has retained within a gemstone (11) which is further retained by a circular holding plate (14); the holding plate is removably fastened to the body of the jewelry article by means of a plurality of mounting screws (12) which are positioned intermediate the margin (13A) major aperture (13) and the circumferential margin (15) of the holding plate. While eight mounting screws (12), viz., fasteners, are illustrated in FIG. 1, any plurality of fasteners might be used.

Figure 2:
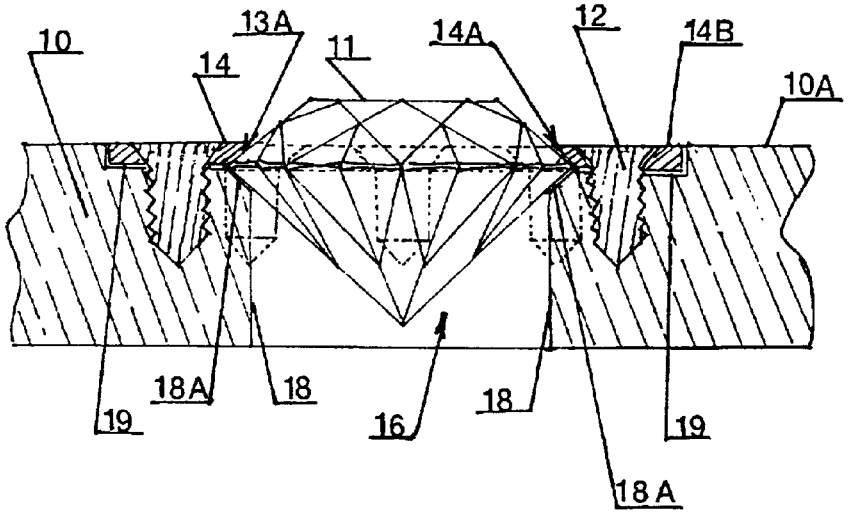
FIG. 2 is a cross-sectional view taken along line 2—2 of FIG. 1.
Figure 3:
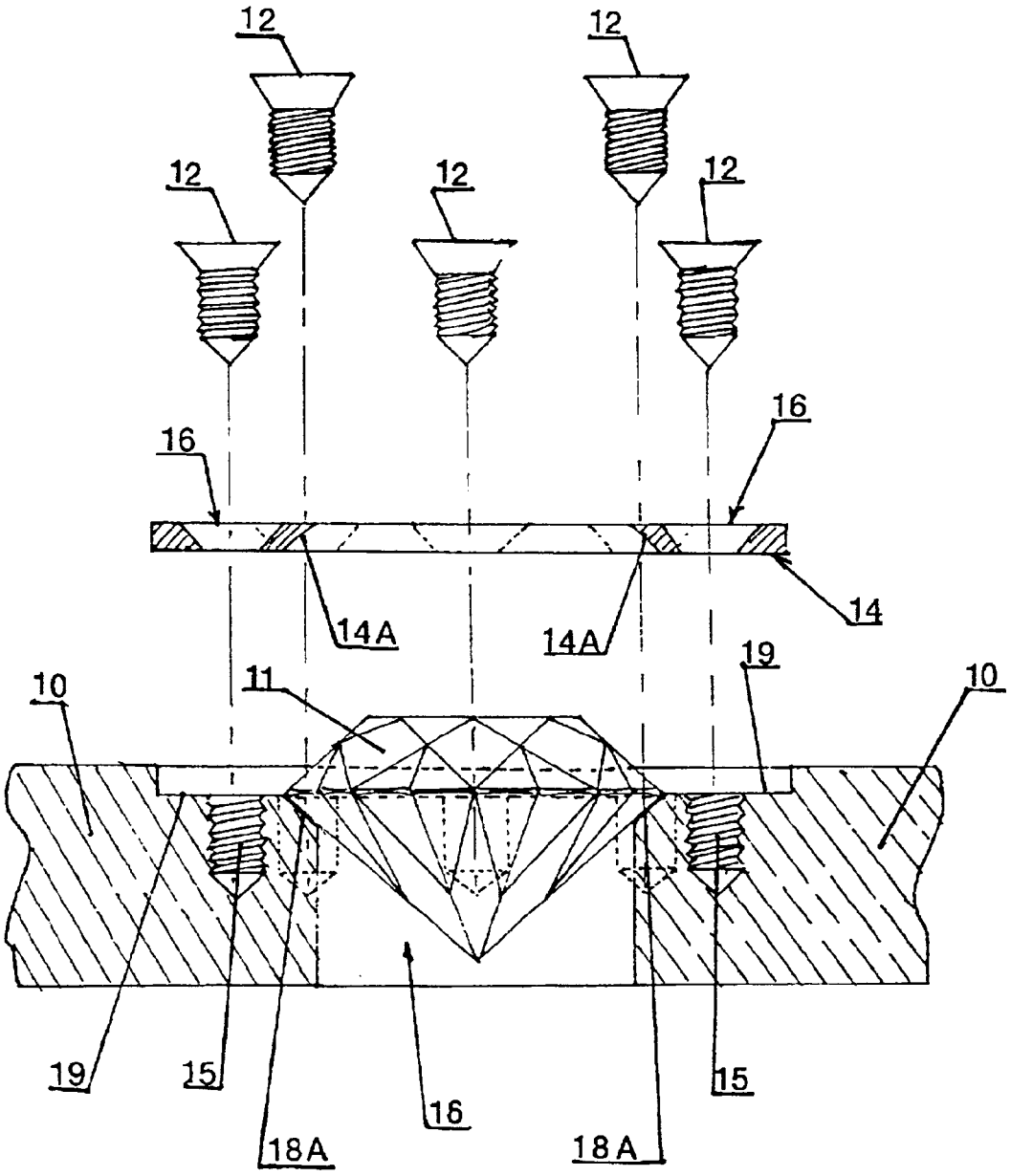
FIG. 3 is an exploded version of FIG. 2 illustrating the embodiments of FIGS. 1 and 2 in more detail.

Turning now to FIG. 2, according to this cross-sectional view taken along line 2—2 of FIG. 1, a passage (16) is seen to pass filly through the body (10) of the jewelry article. It should be understood that the passage (16) need not extend through the body of the jewelry article in which case it would be a cavity in the body of the jewelry article. However, for the benefits of improved illumination of a gemstone (11), such a passage as illustrated is frequently desired and is shown in FIGS. 2 and 3. The cavity or passage (16) includes walls (18) a portion of which (18A) proximate to the mounted holding plate (14) is recessed or chamfered with respect to the walls (18). The holding plate (14) also desirably includes a chamfer or recess (14A) adjacent to or proximate to the margin (13A) of the major aperture. Most preferably, both chamfers or recesses described immediately above the present, but this need not be the case as only one is desired on either the body or the mounting plate. The presence of at least one chamfer or recess provides for good mechanical retention of the gemstone. In FIG. 2, the top surface (14B) of the holding plate as shown coincides viz., is coplanar with the top surface (10A) of the body (10) of the jewelry article, but this not need be the case and these two surfaces **(14*b*, 10A) need not be coincident. According to the preferred embodiment illustrated, there is a recess (19) within the body (10) of the jewelry article within which holding plate (14)** is at least partially fittable.

With reference now to FIG. 3, there is provided an exploded view of the embodiment illustrated on FIGS. 1 and 2. In FIG. 3, are illustrated a plurality of threaded screws (12) and corresponding threaded cavities (15) with matching threads. The holding plate (14) also includes a corresponding number of minor apertures (16) adapted to permit the passage of fasteners therethrough, and into the corresponding threaded cavities (15).

In use, the gemstone inserted within the passage (16) contacts the body (10) of the jewelry article. Desirably, at this point of contact, a chamfer or recess (18A) is present. Thereafter, the holding plate (14) is positioned onto the body (10) such that at least a part of the gemstone (11) is visible through the major aperture of the holding plate, and the minor apertures (16) are aligned with the threaded cavities (15). Subsequently, the plurality of threaded screws (12) are then inserted and rotated into corresponding threaded cavities (15) to retain the holding plate, and gemstone (11) in the body (10) of the jewelry article. Desirably, the holding plate (14) also includes a chamfer or recess (14A) as well which also aids in the mechanical retention of the gemstone. Disassembly is performed by reversing the assembly steps described immediately above.

In an alternate embodiment, the fasteners may be any removable fastener type other than a threaded screw such as friction fitted pins. Where such friction fitted pins are used, it may be desirable to extend the passages (15) to pass completely through the body (10) of the jewelry article whereby a tool may be extended into such passage in order to extract the pin when substitution or replacement of the gemstone is desired.

While not illustrated in the figures, alternatives including the following are considered to be within the scope of the present invention. The holding plate may include a plurality of major apertures to allow for the mounting of two or more gemstones. The holding plate need not be circular as is shown herein, but may be rectangular, triangular, or any other polygonal shape. The holding plate may be formed of two or more elements, which when assembled onto the body of a jewelry article in conjunction to form a holding plate. The holding plate and/or the jewelry article may include ornamental features thereupon. The recessed or chamfered portion of the holding plate and/or body may be a fillet.

I claim:

1. A jewelry article having an openable gem setting for a gemstone which comprises:

a passage within the jewelry article adapted to partially contain a gemstone, the jewelry article having a top with an outer surface and a recess on the top of the jewelry article which is adjacent to the passage, and a plurality of cavities within the recess of the jewelry article;

a removable holder plate having a major aperture, the holder plate being fastened to the top of the jewelry article and being located within the recess such that the holder plate is flush with the outer surface of the jewelry article, the holder plate adapted to contact the gemstone, the holder plate further having a plurality of minor apertures corresponding to the plurality of cavities in the jewelry article, and;

a plurality of removable fasteners inserted through the minor apertures of the holder plate and into the plurality of cavities, the plurality of removable fasteners being adapted to removably fasten the holder plate to the top of the jewelry article.

2. A jewelry article having an openable gem setting for a gemstone according to claim 1 wherein:

the passage includes one of a wall which includes a chamfered, filleted or recessed portion proximate to the removable holder plate.

3. A jewelry article having an openable gem setting for a gemstone according to claim 1 wherein:

the removable holder plate is one of chamfered, filleted or recessed adjacent to the major aperture.

4. A jewelry article having an openable gem setting for a gemstone according to claim 1 wherein:

the plurality of removable fasteners are one of threaded screws or threaded studs.

5. A jewelry article having an openable gem setting for a gemstone according to claim 1 which is selected from the group consisting of:

bracelets, rings, pendants, earrings, belts, belt buckles, as well as clasps and fasteners of an ornamental nature.

6. A jewelry article having an openable gem setting for a gemstone according to claim 1 wherein:

the jewelry article has a body and the passage adapted to partially contain a gemstone is a cavity within the body of the jewelry article.

* * * * *